US007926876B2

(12) United States Patent
Zadai et al.

(10) Patent No.: US 7,926,876 B2
(45) Date of Patent: Apr. 19, 2011

(54) CHAIR LIFT

(76) Inventors: Robert F. Zadai, Warren, OH (US); Larry R. Elliott, Cortland, OH (US)

( * ) Notice: Subject to any disclaimer, the term of this patent is extended or adjusted under 35 U.S.C. 154(b) by 155 days.

(21) Appl. No.: 12/346,495

(22) Filed: Dec. 30, 2008

(65) Prior Publication Data

US 2010/0164264 A1 Jul. 1, 2010

(51) Int. Cl.
*A47C 1/00* (2006.01)

(52) U.S. Cl. ..... 297/344.17; 297/344.1; 297/344.15; 297/DIG. 10

(58) Field of Classification Search ..... 297/344.1, 297/344.14, 344.15, 344.17, DIG. 10, 344.12
See application file for complete search history.

(56) References Cited

U.S. PATENT DOCUMENTS

| | | | | |
|---|---|---|---|---|
| 4,010,499 | A | 3/1977 | Davis et al. | |
| 4,850,645 | A * | 7/1989 | Crockett | 297/330 |
| 4,946,222 | A * | 8/1990 | Matson | 297/344.17 |
| 5,155,873 | A * | 10/1992 | Bridges | 4/667 |
| 5,294,179 | A * | 3/1994 | Rudes et al. | 297/330 |
| 5,427,337 | A | 6/1995 | Biggs | |
| 5,588,162 | A * | 12/1996 | Robinson | 4/667 |
| 5,641,201 | A * | 6/1997 | Casey et al. | 297/326 |
| 5,695,248 | A * | 12/1997 | Bell | 297/344.17 |
| 5,816,655 | A | 10/1998 | Hoegh | |
| 6,000,758 | A | 12/1999 | Schaffner et al. | |
| 6,170,911 | B1 * | 1/2001 | Kassai et al. | 297/250.1 |
| 6,385,797 | B1 * | 5/2002 | Phillips | 4/667 |
| 6,957,456 | B2 * | 10/2005 | Darling et al. | 5/509.1 |
| 6,997,424 | B2 * | 2/2006 | Atkinson, Jr. | 248/346.01 |
| 7,090,297 | B2 * | 8/2006 | Mohn et al. | 297/330 |

FOREIGN PATENT DOCUMENTS

JP 58199231 A * 11/1983

* cited by examiner

*Primary Examiner* — Laurie K Cranmer
(74) *Attorney, Agent, or Firm* — Dale J. Ream

(57) ABSTRACT

A chair lift includes a jack movable between lowered and raised configurations and a motor in communication with the jack for moving the jack between the lowered and raised configurations. A switch is in communication with the motor to selectively actuate the motor. A mounting bracket is coupled to the jack to move vertically as the jack moves between the lowered and raised configurations, the mounting bracket having opposed first and second ends. First and second clamping mechanisms are configured for attachment to respective chair legs, the first and second clamping mechanisms being below the mounting bracket. A first flexible connecting link extends between and coupled to the mounting bracket first end and the first clamping mechanism. A second flexible connecting link extends between and coupled to the mounting bracket second end and the second clamping mechanism.

13 Claims, 8 Drawing Sheets

CHAIR LIFT

BACKGROUND OF THE INVENTION

This invention relates generally to chair lifting devices and, more particularly, to a chair lift that is attachable to and removable from most reclining chairs and which raises a chair without hampering the basic functions or attractive appearance of the chair.

One of the most difficult activities for many older people and people with physical disabilities is to get up out of a chair, especially large recliner type chairs. Sometimes the most comfortable chairs in which a person just sinks into are the most difficult chairs to stand up from. A person who lacks physical strength or coordination may find it awkward or even impossible to scoot forward and then stand up from the comfortable chair.

Various devices have been proposed in the art for lifting or tipping recliner chairs in order to assist persons lacking sufficient physical strength or coordination to rise from the chair without assistance. Although assumably effective for their intended purposes, the existing devices do not provide an after market product that may be quickly and easily attached to most recliner type chairs and do not actually lift the entire chair.

Therefore, it would be desirable to have a chair lift that may be attached to and removed from to most recliner type chairs quickly and easily. Further, it would be desirable to have a chair lift having a flexible link between the jack and the chair legs so as to make the chair more stable when lifting. In addition, it would be desirable to have a chair lift that does not affect the basic functions or attractive appearance of the chair.

SUMMARY OF THE INVENTION

Accordingly, a chair lift according to the present invention includes a jack movable between lowered and raised configurations and a motor in communication with the jack for moving the jack between the lowered and raised configurations. A switch is in communication with the motor to selectively actuate the motor. A mounting bracket is coupled to the jack to move vertically as the jack moves between the lowered and raised configurations, the mounting bracket having opposed first and second ends. First and second clamping mechanisms are configured for attachment to respective chair legs, the first and second clamping mechanisms being below the mounting bracket. A first flexible connecting link extends between and coupled to the mounting bracket first end and the first clamping mechanism. A second flexible connecting link extends between and coupled to the mounting bracket second end and the second clamping mechanism.

Therefore, a general object of this invention is to provide a chair lift for assisting a person in standing up out of a chair.

Another object of this invention is to provide a chair lift, as aforesaid, that may be easily and quickly attached to or removed from most reclining type chairs.

Still another object of this invention is to provide a chair lift, as aforesaid, that maintains a proper angle of the chair during the lifting process.

Yet another object of this invention is to provide a chair lift, as aforesaid, that does not inhibit the basic functions or appearance of the chair to which it is attached.

A further object of this invention is to provide a chair lift, as aforesaid, that is east to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
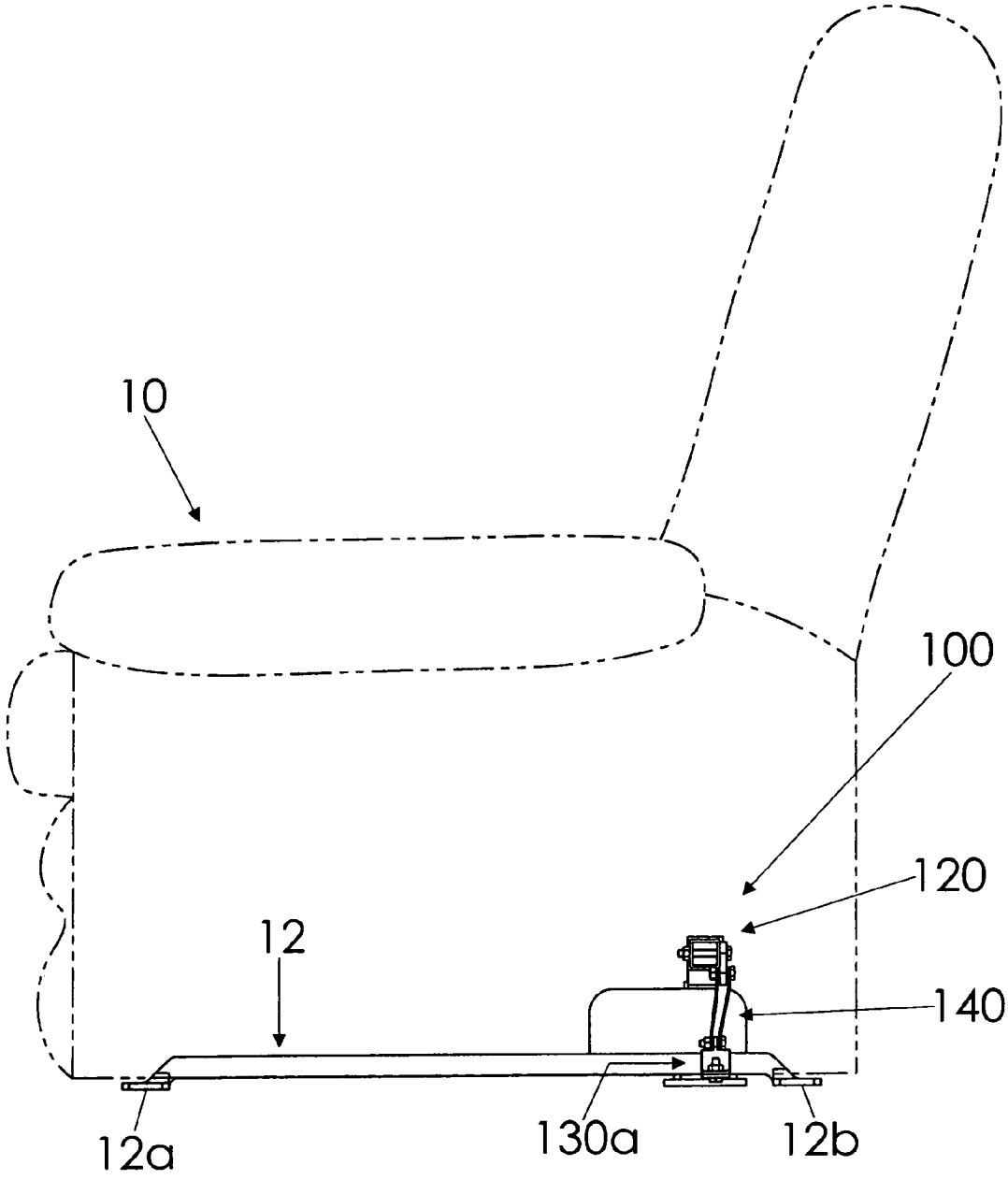
FIG. 1 is a side view of a chair lift according to a preferred embodiment of the present invention in use with a reclining chair and in a lowered configuration.

A chair lift will now be described in detail with reference to FIG. 1 through FIG. 7*b* of the accompanying drawings. More particularly, a chair lift 100 includes a jack 110, a mounting bracket 120, clamping mechanisms 130, and flexible connecting links 140.

Figure 5A:
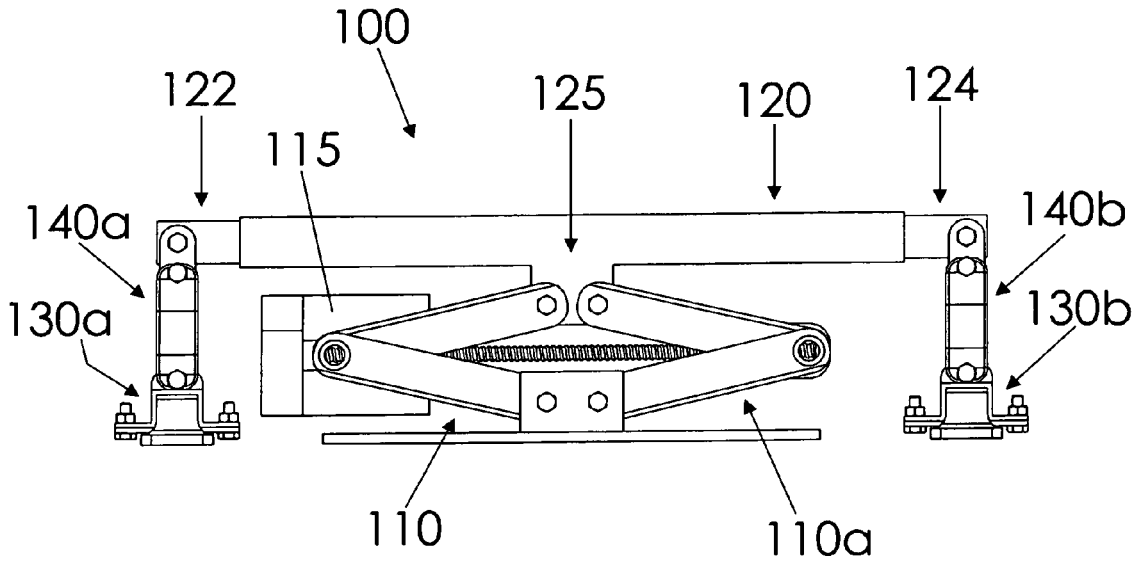
FIG. 5*a* is a front view of the chair lift as in FIG. 4*a* in a lowered configuration.
Figure 5B:
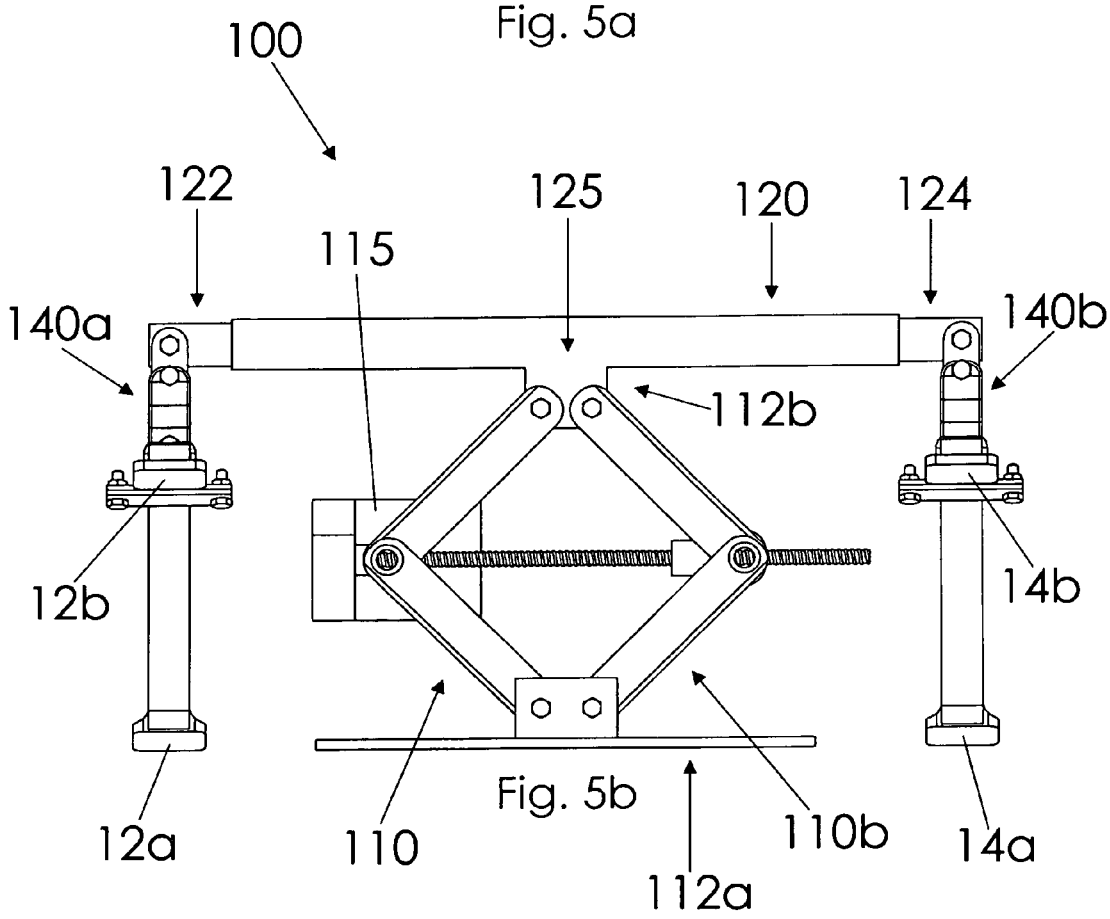
FIG. 5*bis* a perspective view of the chair lift as in FIG. 4*a* in a raised configuration.
Figure 6A:
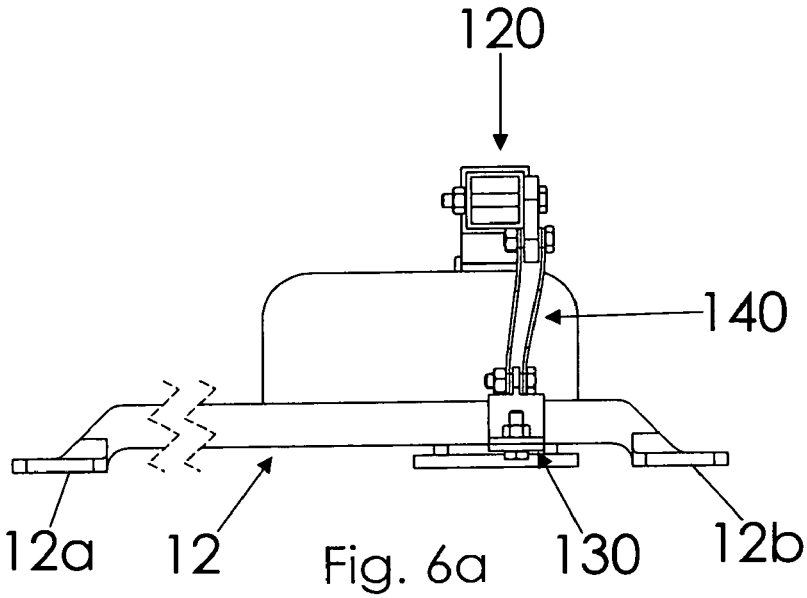
FIG. 6*a* is a side view of the chair lift as in FIG. 1 in a lowered configuration and with the chair removed.
Figure 6B:
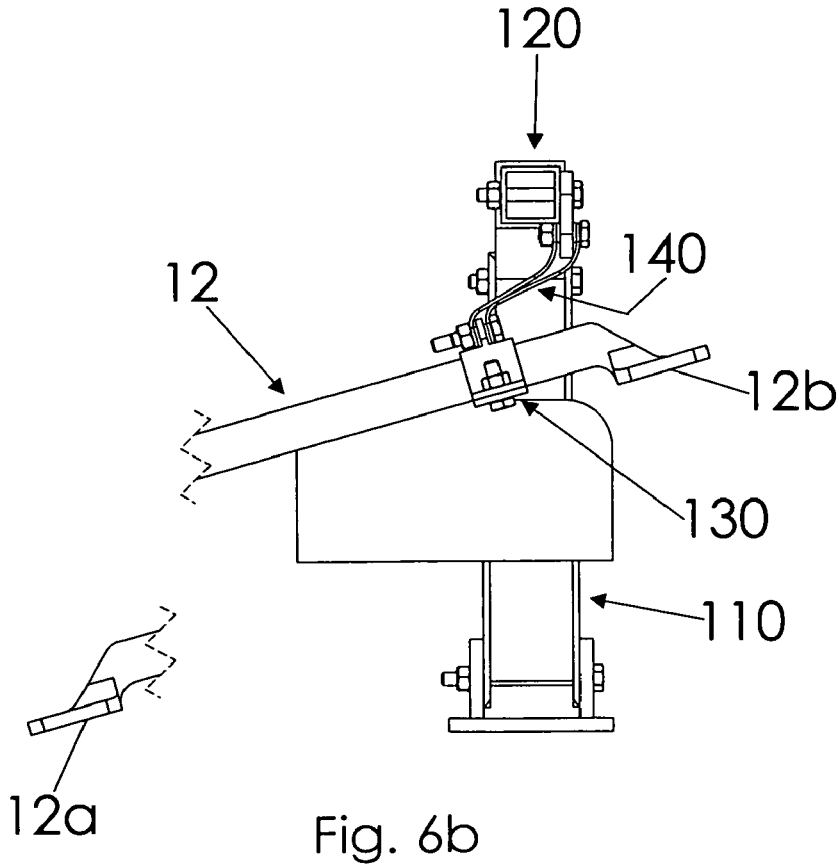
FIG. 6*b* is a side view as in FIG. 2 in a raised configuration and with the chair removed.

As shown in FIGS. 5*a* and 5*b*, the jack 110 is movable between lowered and raised configurations 110*a*, 110*b*. The jack 110 has a lower end 112*a* adjacent a ground surface and an opposed upper end 112*b* that may move up and down. A motor 115 is in communication with the jack 110 for moving the jack 110 between the lowered and raised configurations 110*a*, 110*b*, and a switch 113 is in communication with the motor 115 to selectively actuate the motor 115. In some embodiments, the user may actuate the switch through a remote control. The jack 110 may be a scissor jack, as shown in FIGS. 5*a* and 5*b*, or any other appropriate type of jack.

Figure 7A:
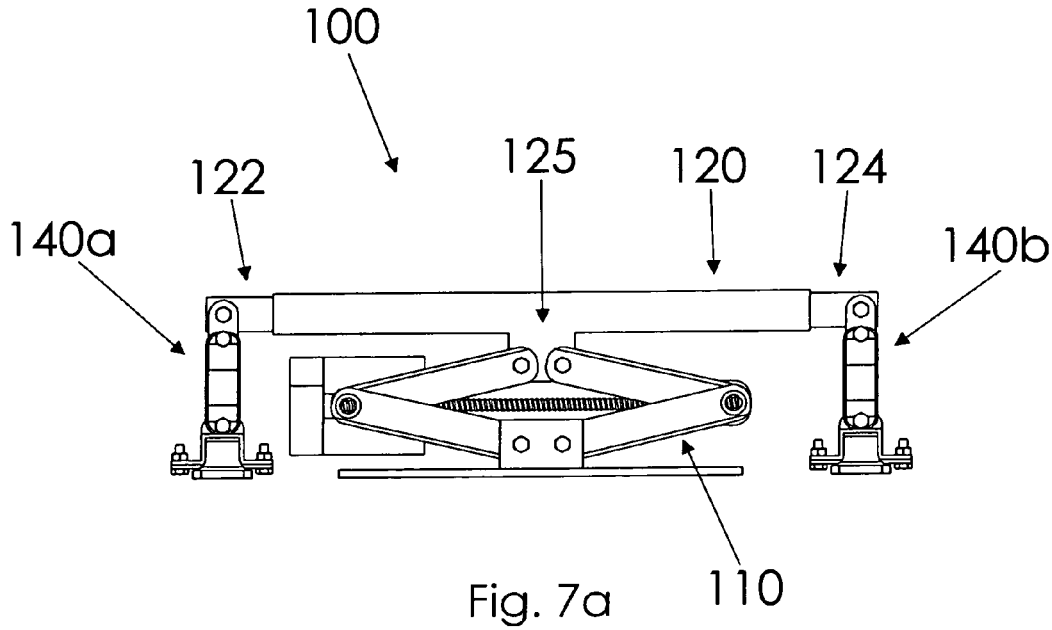
FIG. 7*a* is a front view of the chair lift with the ends of the mounting bracket in retracted configurations.
Figure 7B:
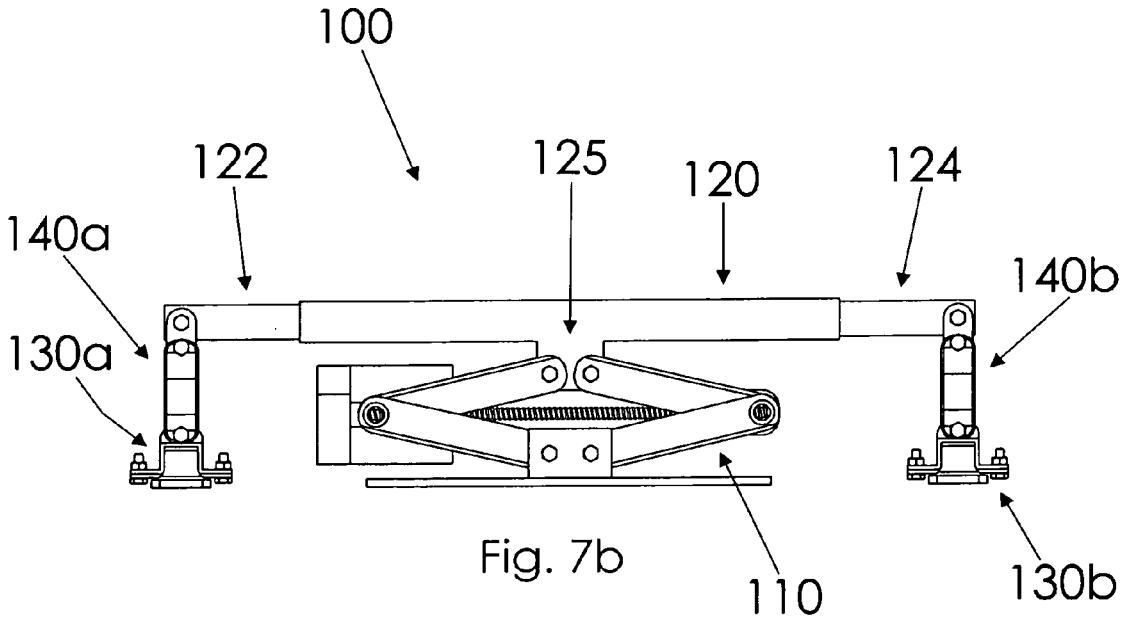
FIG. 7*b* is a front view of the chair lift with the ends of the mounting bracket in extended configurations.
Figure 8:
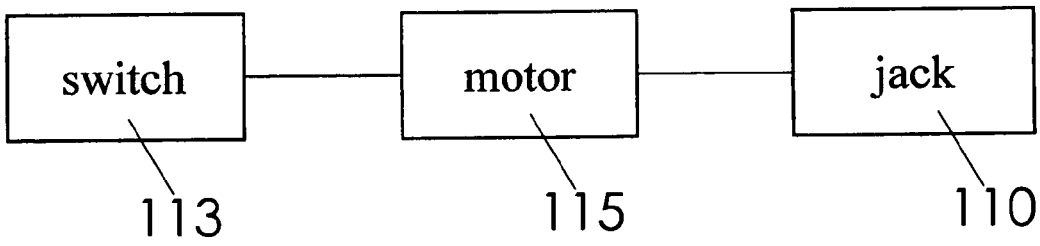
FIG. 8 is a block diagram illustrating the operative components of the present invention.

The mounting bracket 120 is coupled to the jack 110 to move vertically as the jack 110 moves between the lowered and raised configurations 110*a*, 110*b*, and the mounting bracket 120 has opposed first and second ends 122, 124 (FIGS. 7*a* and 7*b*). A generally central region 125 of the mounting bracket 120 may be coupled to the upper end 112*b* of the jack 110 such that the first and second ends 122, 124 are generally equidistant from the jack upper end 112*b*, and the first and second ends 122, 124 may be telescoping, as shown in FIGS. 7*a* and 7*b*.

Figure 3:
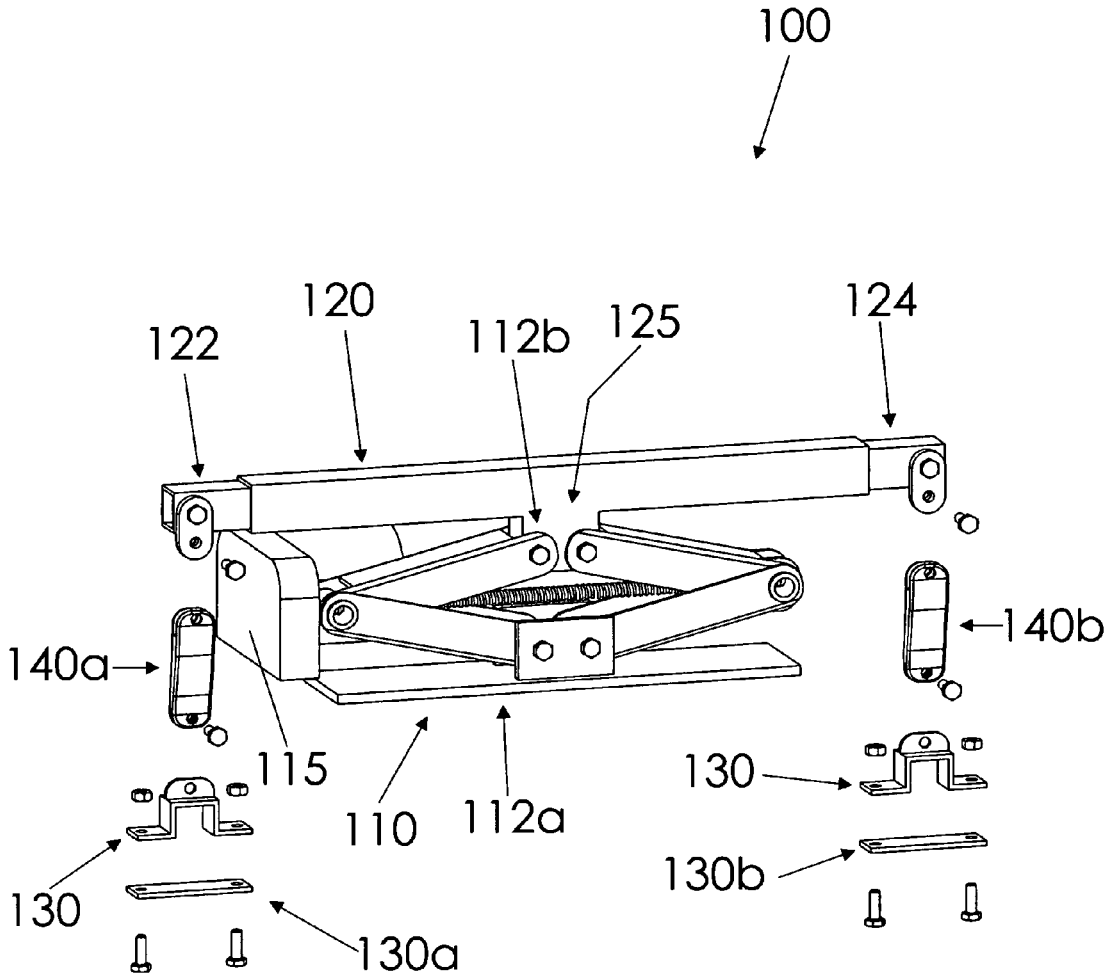
FIG. 3 is an exploded view of the chair lift as in FIG. 1 with the chair removed.
Figure 4A:
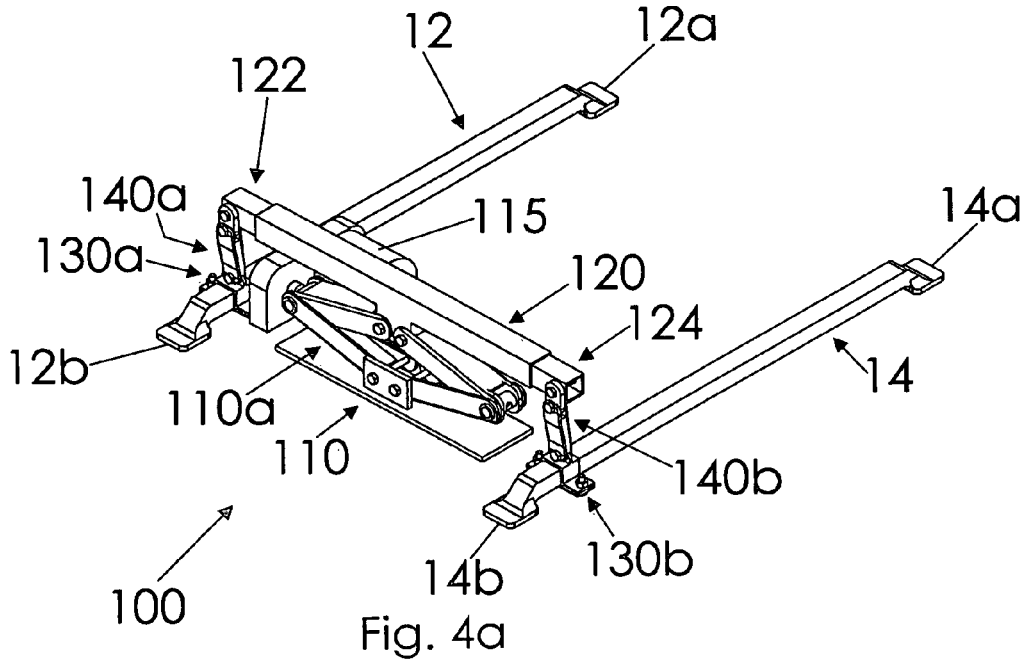
FIG. 4*a* is a perspective view of the chair lift as in FIG. 3 in a lowered configuration.
Figure 4B:
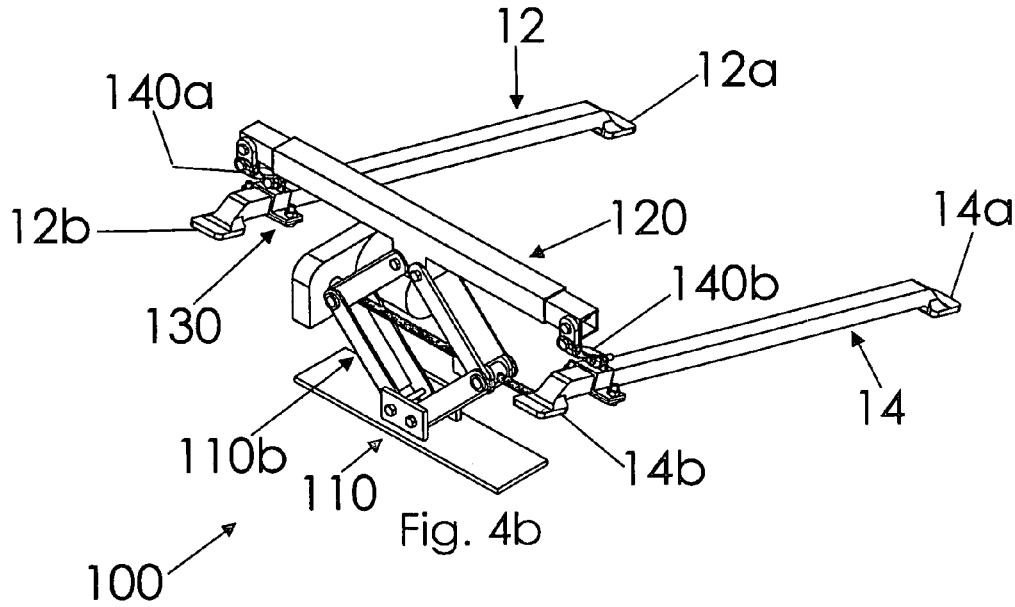
FIG. 4*b* is a perspective view of the chair lift as in FIG. 4*a* in a raised configuration.

As shown in FIG. 3, two clamping mechanisms 130 (often referred to herein as the first and second clamping mechanisms 130*a*, 130*b*) are below the mounting bracket 120. The clamping mechanisms 130*a*, 130*b* are configured to be attached to respective chair legs, and it may be desirable for the clamping mechanisms 130*a*, 130*b* to be configured for attachment to generally horizontal chair leg elements. For example, as shown in FIGS. 1, 4*a*, and 4*b*, a chair 10 may have generally horizontal first and second rails 12, 14, each rail 12, 14 may have a front foot 12*a*, 14*a* and a rear foot 12*b*, 14*b*, the first clamping mechanism 130*a* may be configured to attach to the first rail 12 adjacent the rear foot 12*b*, and the second clamping mechanism 130*b* may be configured to attach to the second rail 14 adjacent the rear foot 14*b*. In some embodiments, the clamping mechanisms are configured for removable attachment so that the chair lift 100 may be separated from one chair 10 and used with another chair 10.

Two flexible connecting links 140 (often referred to herein as the first and second connecting links 140*a*, 140*b*) couple the clamping mechanisms 130 to the mounting bracket 120. More particularly, as shown in FIG. 3, the first connecting link 140*a* extends between and is coupled to the mounting bracket first end 122 and the first clamping mechanism 130*a*; the second connecting link 140*b* extends between and is coupled to the mounting bracket second end 124 and the second clamping mechanism 130*b*. In some embodiments, the connecting links 140 are constructed of a rubber material, and a wire may be enclosed in the rubber material for each connecting link 140 for reinforcement.

Figure 2:
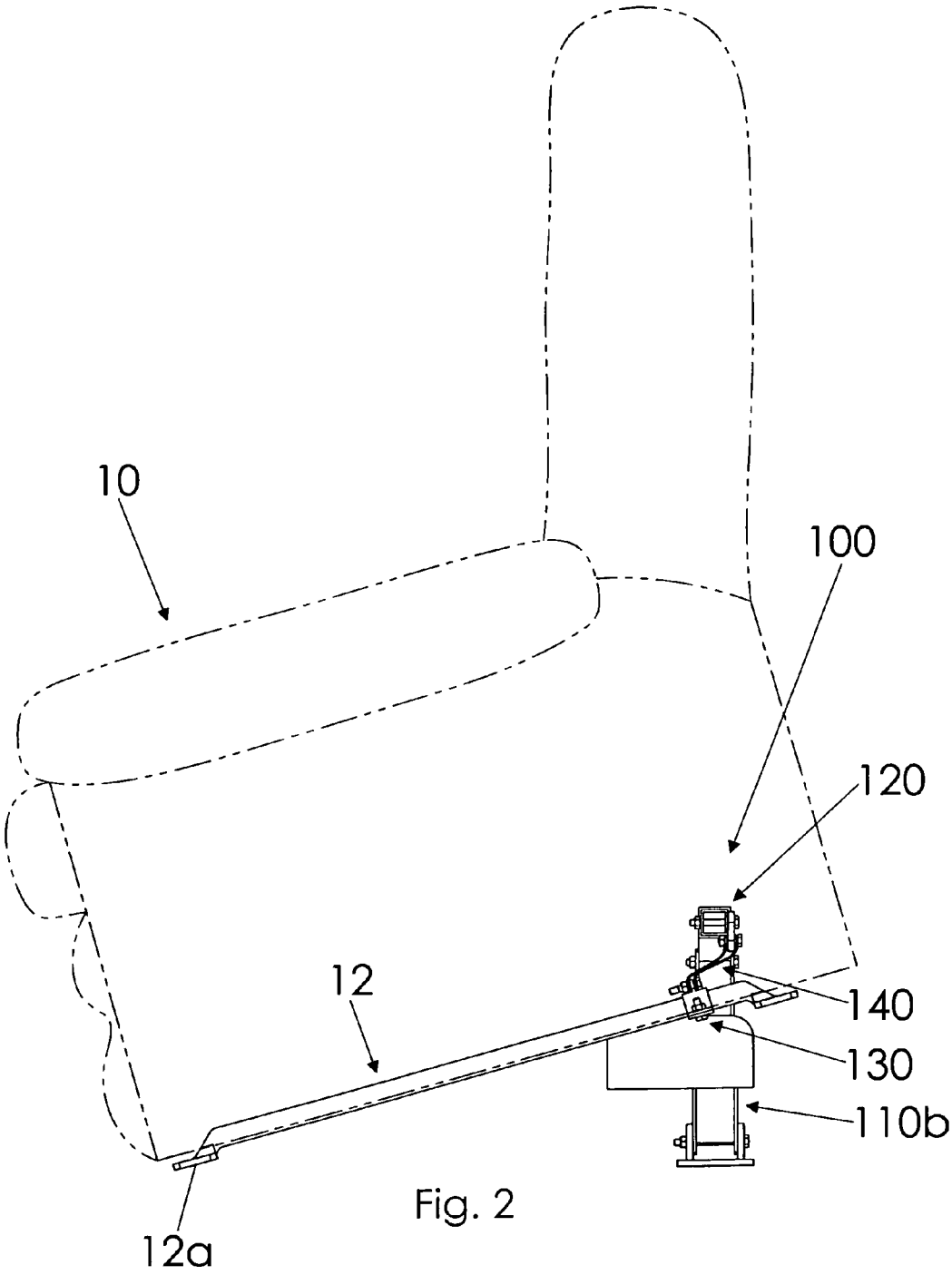
FIG. 2 is a side view of the chair lift as in FIG. 1 in a raised configuration.

In use, the chair lift 100 may be coupled to a chair 10 by the first and second clamping mechanisms 130*a*, 130*b*. If the first and second ends 122, 124 of the mounting bracket 120 are telescoping, the chair lift 100 may be coupled to chairs 10 of various dimensions by adjusting the positions of the first and second ends 122, 124. To raise the rear end of the chair 10 (e.g., to aid in egress,) the switch may be used to activate the motor 115, which in turn moves the jack 110 from the lowered configuration 110*a* (FIGS. 1, 4*a*, 5*a*, and 6*a*) to the raised configuration 110*b* (FIGS. 2, 4*b*, 5*b*, and 6*b*). Raising the jack 110 causes the mounting bracket 120 to raise, the connecting links 140 to raise, the clamping mechanisms 130 to raise, and therefore the chair 10 to raise (FIG. 2). The flexible nature of the connecting links 140 may allow the chair legs to rotate about fixed points. For example, it may allow the first and second rails 12, 14 to rotate about the front feet 12*a*, 14*a* while the front feet 12*a*, 14 remain generally in place on the ground. The jack 110 may then be returned to the lowered configuration 110*a* by the motor 115, which in turn causes the chair 10 to return to the ground (FIG. 1).

It is understood that while certain forms of this invention have been illustrated and described, it is not limited thereto except insofar as such limitations are included in the following claims and allowable functional equivalents thereof.

The invention claimed is:

1. A chair lift, comprising:

a jack movable between lowered and raised configurations;

a motor in communication with said jack for moving said jack between said lowered and raised configurations;

a switch in communication with said motor to selectively actuate said motor;

a mounting bracket coupled to said jack to move vertically as said jack moves between said lowered and raised configurations, said mounting bracket having opposed first and second ends;

first and second clamping mechanisms configured for attachment to respective chair legs, said first and second clamping mechanisms being below said mounting bracket;

a first flexible connecting link extending between and coupled to said mounting bracket first end and said first clamping mechanism; and a second flexible connecting link extending between and coupled to said mounting bracket second end and said second clamping mechanism.

2. The chair lift of claim 1, wherein said mounting bracket is coupled to said jack at a generally central region of said mounting bracket and an upper end of said jack such that said mounting bracket first and second ends are generally equidistant from said jack upper end.

3. The chair lift of claim 2, wherein said first and second ends of said mounting bracket are telescoping.

4. The chair lift of claim 3, wherein said jack is a scissor jack.

5. The chair lift of claim 4, wherein:

said chair legs extend generally horizontally; and said clamping mechanisms are configured for removable attachment to respective chair legs.

6. The chair lift of claim 1, wherein said first and second ends of said mounting bracket are telescoping.

7. A chair lift for operatively lifting a portion of a chair off a ground surface and being adjustable for use with chairs of various dimensions, said chair lift comprising:

a jack movable between lowered and raised configurations, said jack having a lower end adjacent the ground surface and an opposed upper end;

a motor in communication with said jack to move said jack between said lowered and raised configurations;

a switch in communication with said motor to selectively actuate said motor;

a mounting bracket coupled to said jack upper end to move vertically as said jack moves between said lowered and raised configurations, said mounting bracket having opposed first and second telescoping ends;

first and second clamping mechanisms configured for attachment to respective chair legs, said first and second clamping mechanisms being below said mounting bracket;

a first flexible connecting link extending between and coupled to said mounting bracket first end and said first clamping mechanism; and a second flexible connecting link extending between and coupled to said mounting bracket second end and said second clamping mechanism.

8. The chair lift of claim 7, wherein:

said first clamping mechanism is configured to attach to a generally horizontal portion of a first said chair leg;

said second clamping mechanism is configured to attach to a generally horizontal portion of a second said chair leg; and vertical movement of said mounting bracket causes said generally horizontal portion of said first chair leg to rotate about a first fixed point and causes said generally horizontal portion of said second chair leg to rotate about a second fixed point.

9. The chair lift of claim 7, wherein said mounting bracket is coupled to said jack at a generally central region of said mounting bracket and said upper end of said jack such that said mounting bracket first and second ends are generally equidistant from said jack upper end.

10. A chair lift for use with a chair having generally horizontal first and second rails, each rail having a front foot and a rear foot, to operatively lift said rear feet off a ground surface and allow said front feet to remain on said ground surface, said chair lift comprising:

a jack movable between lowered and raised configurations;

a motor in communication with said jack for moving said jack between said lowered and raised configurations;

a switch in communication with said motor to selectively actuate said motor;

a mounting bracket coupled to said jack to move vertically as said jack moves between said lowered and raised configurations, said mounting bracket having opposed first and second ends;

a first clamping mechanism configured to attach to said first rail adjacent said first rail rear foot, said first clamping mechanism being below said mounting bracket;

a second clamping mechanism configured to attach to said second rail adjacent said second rail rear foot, said second clamping mechanism being below said mounting bracket;

a first flexible connecting link extending between and coupled to said mounting bracket first end and said first clamping mechanism; and a second flexible connecting link extending between and coupled to said mounting bracket second end and said second clamping mechanism;

wherein vertical movement of said mounting bracket causes said first and second rails to rotate about said front feet.

11. The chair lift of claim 10, wherein said mounting bracket is coupled to said jack at a generally central region of said mounting bracket and an upper end of said jack such that said mounting bracket first and second ends are generally equidistant from said jack upper end.

12. The chair lift of claim 11, wherein said first and second ends of said mounting bracket are telescoping.

13. The chair lift of claim 10, wherein:

said clamping mechanisms are configured for removable attachment to said rails; and said first flexible connecting link and said second flexible connecting link each include a wire enclosed in said rubber material.

* * * * *